US006691354B1

(12) United States Patent
Sheppard

(10) Patent No.: US 6,691,354 B1
(45) Date of Patent: Feb. 17, 2004

(54) INFLATABLE BODY SUPPORT

(76) Inventor: Joseph A. Sheppard, 535 Shade Rd., Cincinnati, OH (US) 45255

( * ) Notice: Subject to any disclaimer, the term of this patent is extended or adjusted under 35 U.S.C. 154(b) by 0 days.

(21) Appl. No.: 09/974,238

(22) Filed: Oct. 10, 2001

(51) Int. Cl.[7] ..... A47C 27/08
(52) U.S. Cl. ..... 5/710; 5/733; 5/735
(58) Field of Search ..... 5/710, 731, 733, 5/735, 655.3

(56) References Cited

U.S. PATENT DOCUMENTS 4,737,999 A * 4/1988 Halverson ..... 5/710
D403,194 S * 12/1998 Thurston ..... 5/735
6,233,768 B1 * 5/2001 Harding ..... 5/735

* cited by examiner

*Primary Examiner*—Teri Pham Luu
*Assistant Examiner*—Fredrick Conley

(57) ABSTRACT

An inflatable therapeutic mattress for supporting a resting body in the prone position while maintaining proper spinal alignment, features an upper surface with a pair of opposing slanting surfaces originating from an elevated ridge, one slanting surface larger than the other. The larger slanting surface has a pillow to elevate the abdominal area of the resting body, and the smaller slanting surface has a pillow with a void to accommodate the face of the resting body.

3 Claims, 2 Drawing Sheets

INFLATABLE BODY SUPPORT

BACKGROUND OF THE INVENTION

This disclosure relates generally to an apparatus for the treatment of back pain or other discomfort originating from or associated with the misalignment of the spinal column. More specifically, this disclosure relates to an inflatable mattress, typically comprising several air bladders, that when inflated with air will assume a shape suitable for supporting the human body in an aligned and therapeutically advantageous prone position. When used properly, the disclosed mattress will support a prone body at rest in an alignment permitting and encouraging all of the vertebrae of the spinal cord to be maintained in the appropriate orientation.

The spinal column has a variety of functions. Primarily, it maintains the structure of the trunk by providing a place of attachment for muscles, ligaments and tendons, and it provides a barrier protecting the brain and spinal cord. Each vertebra in the spinal column has numerous joints permitting its connection to the adjacent vertebrae. Each joint allows for a wide range of movement, and proper alignment of these joints and vertebrae is essential for correct movement and proper spinal bio-mechanics.

The spinal column has four curves; each curve adds to the strength and stability of the spine and absorbs and distributes the forces placed on the spinal column, and, in fact, a spinal column with proper or correct curvature is reported to be ten times stronger than one that is misconfigured.

The spinal column is comprised of 24 movable vertebra and a fused sacrum or tailbone. The seven cervical or neck bones are the smallest and most maneuverable vertebrae. They permit rotation and side to side and forward and backward mobility. The cervical curvature is called "lordotic" and is normally "C" shaped. An altered or reduced cervical curve typically straightens or reverses resulting in weakened neck mechanics. Weakened neck mechanics causes increased tension on the neck region resulting in muscular imbalance and painfull pressure on the nerves of the cervical area Lying, resting or sleeping in the natural prone position will exacerbate the discomfort of a reduced cervical curve by placing additional strain on the neck muscles and pressure on the delicate spinal nerves.

The vertebrae of the middle back or thoracic region create another curve called "kyphotic." These vertebrae are not as mobile as the cervical vertebrae. Their primary function is to provide for organ protection and for the attachment of the ribs. The lumbar or lower back region has five vertebrae. They are characterized by their weigh-bearing ability. They are also configured in a C-shaped curve, which is called "lordotic." A decreased or flattened lordotic curve reduces the strength of the back and places undue pressure on the small joints, spinal nerves and the shock-absorbing discs of the lumbar region. Sleeping or resting in the prone position is not recommended for anyone, and it will exacerbate a reduced lordotic curve resulting in pain, spasms and discomfort in the lumbar region.

Low back pain is the most common musculoskeletal ailment in the world today. In addition to the personal suffering and discomfort, it costs society billions of dollars in medical treatments and lost productivity every year. Poor lifting techniques, altered spinal mechanics, typically resulting from injury or trauma, and poor posture are the primary causes of low back pain. Statistics show that 80% of the people in the United States will experience low back pain at least once in their lifetime. And when it occurs, it will be debilitating enough to cause absence from work. For those with chronic or refractory back pain, the associated problems will be magnified.

With the advent and then the prevalence of the personal computer over the past couple of decades, and the ergonomic misalignment of chairs and desks, neck pain and tension have also increased dramatically. In office environments, 30–40% of the employees experience some type of neck pain or stiffness on a regular basis. And again, enormous sums of money are spend on medications to address the symptoms when, in fact, the problem is pressure on the nerves of the spinal column resulting from tension and poor posture.

DESCRIPTION OF THE PRIOR ART

Mattresses and flotation devices have been used previously to assist in aligning the spine and alleviate back pain and discomfort. Relevant examples of these devices include the support cushion described in U.S. Pat. No. 4,473,913, which issued to Ylvisaker on Oct. 2, 1984. Specifically, the disclosed device is an elongated cushion for therapeutically supporting a person in an arched, face-down, prone position. The cushion has an upper surface, which slopes upwardly from each end toward the middle. At one end is a channel, serving as an unobstructed passageway for air to allow the person being supported to breath while in the prone position.

U.S. Pat. No. 5,086,529, which issued to DeGroot on Feb. 11, 1992 describes an inflatable segmented mattress device wherein the head segment can accommodate the face for purposes of breathing and yet support the face in an orientation that encourages normal curvature and alignment of the spine.

SUMMARY OF THE INVENTION

Notwithstanding the features and teachings propounded by the prior art, there remains a need for an affordable inflatable mattress specifically designed to maintain the spinal column of an individual in the preferred orientation while lying or resting in a prone position. More specifically, the disclosed therapeutic mattress for supporting the human body in a prone position and maintaining the spinal column of the body in a preferred orientation features an elongated portion having an upper surface comprising a pair of sloping surfaces, one larger than the other, each sloping in opposing directions from an elevated ridge on the upper surface. Furthermore, to elevate the abdominal area and to reestablish the normal curve of the lumbar vertebrae of the resting prone body, the mattress has a pillow or padded structure positioned medially on the larger sloping surface; and to accommodate the face and re-establish the cervical curve of the resting body, a pillow having a void or depression is positioned medially on the surface of the smaller sloping surface.

DETAILED DESCRIPTION OF THE PREFERRED EMBODIMENT

Because neck and back pain resulting from poor posture, repetitive work routines and altered spinal curves are a major health concern in our society today, the inflatable body mattress disclosed and described herein offers solace to those who persist in resting or recreating in a prone position for prolonged periods of time. The inflatable mattress described in detail in this disclosure encourages specific chiropractic enhancing angles in the neck and low back region designed to decrease neck tension, reduce nerve irritation and encourage correct spinal curves, resulting in improved spinal mechanics. The cervical frontal angle of the flotation device increases and promotes the normal "C" curvature by putting the head in flexion or forward position, instead of the extension that would result from the normal prone position. The opposing slanting surfaces of about 7° and 3° increase the kyphotic middle back curve, thus decreasing the overall tension on the neck and low back regions. The abdominal support pillow functions to reduce pressure on the lumbar spinal nerves, decrease muscular tension, and improve spinal mechanics. The abdominal support pillow, accompanied with the 3°–5° angle decline, positions the lumbar region in forward flexion, instead of the extension that would result from the normal prone position.

Figure 1:
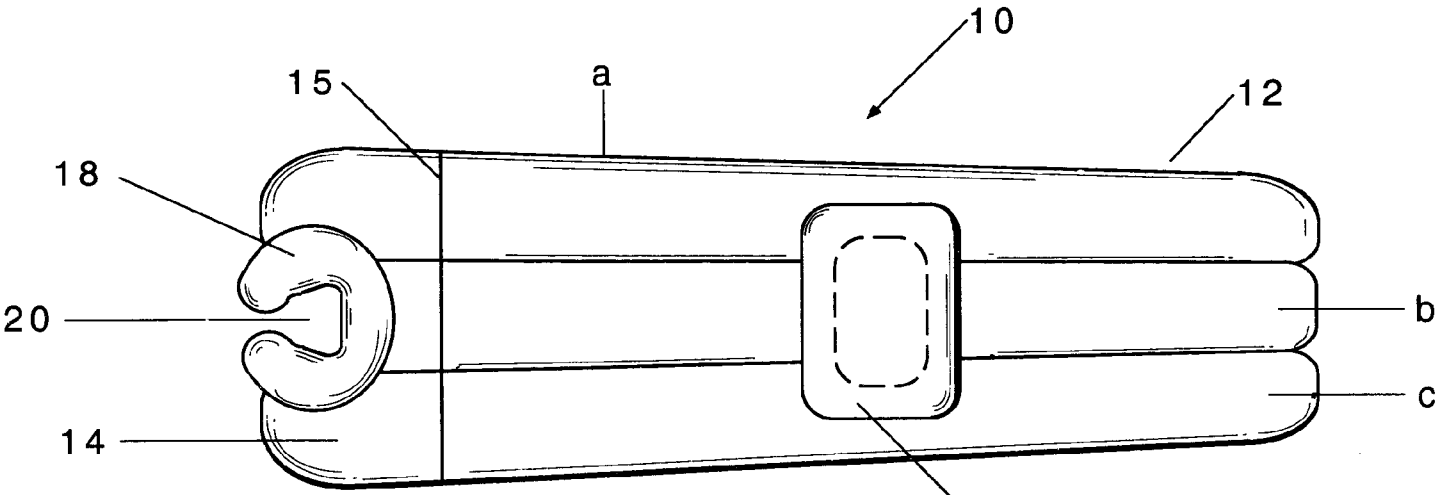
FIG. 1 is a top plan view of the disclosed mattress, fully inflated.
Figure 2:
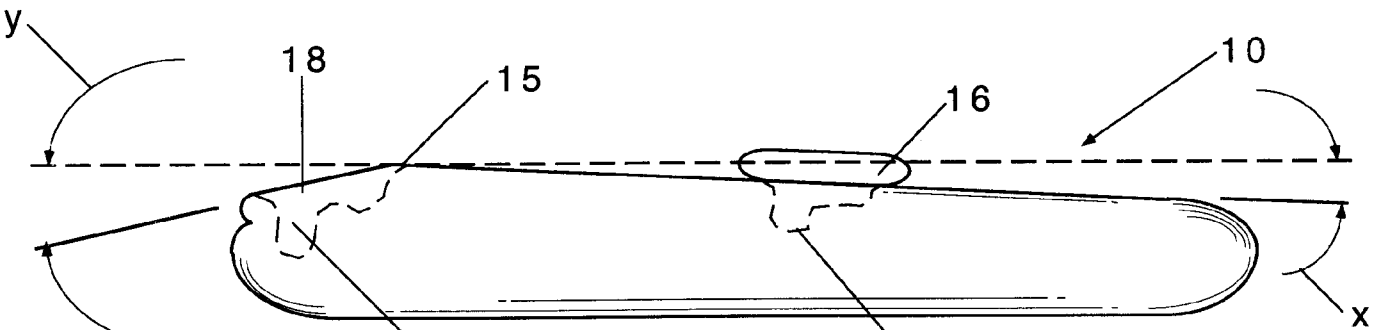
FIG. 2 is an elevated side view of the disclosed mattress, fully inflated.

With specific regard to the disclosed inflatable mattress, reference should be made to FIGS. 1 and 2 of the drawing. FIG. 1, a top plan view, illustrates most of the essential features of the mattress 10. The upper surface of the mattress consists primarily of a pair of sloping surfaces 12,14. In other words, the upper surface of the mattress 10 is never flat. The larger of the sloping surfaces 12 originates from an elevated ridge 15 on the upper surface of the mattress and extends at a slope of about 3°–5° (X) to the foot-end of the mattress 10. The smaller sloping surface 14 also originates at the elevated ridge 15 and extends at a slope of about 5°–10° (Y) to the head-end of the mattress 10.

An abdominal pillow 16 is located medially on the larger sloping surface 12. By its structure and location, the pillow 16 will elevate the abdominal area of the body lying prone on the mattress 10.

On the smaller sloping surface 14, another pillow 18 is positioned medially to accommodate the head of a body in either the prone or supine position. The pillow 18, additionally, has or defines a void 20 for accommodating the face and providing a pocket of air for breathing when the body is in the prone position. In a preferred embodiment, the pillow 18 is generally horseshoe-shaped and the void 20 is created by the inner sides of the pillow 18. Typically, the pillow 18 will be inflated separately from the other elements of the mattress 10 to provide a measure of control over the size and rigidity of the pillow 8. Similarly, the abdominal pillow 16 will also be separately inflatable to provide the same opportunity to regulate, to some extent, its size and firmness.

The main body of the mattress 10 preferably consists of three bladders a, b, and c, extending under the entire length of the mattress 10. Each bladder will, of course, be separately and individually constructed and inflated. Such a design will allow the components of the mattress to be inflated to varying degrees of rigidity. The bladders will, of course, be enveloped to present a mattress of unitary construction.

Figure 3:
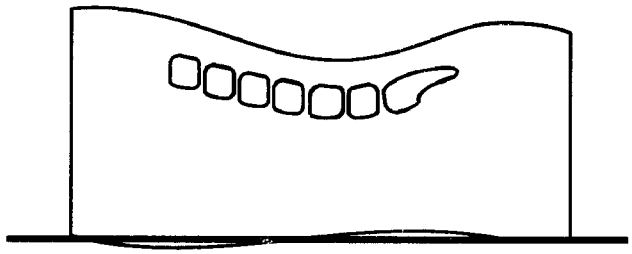
FIG. 3 is a depiction of the lumbar vertebrae of a prone individual.
Figure 4:
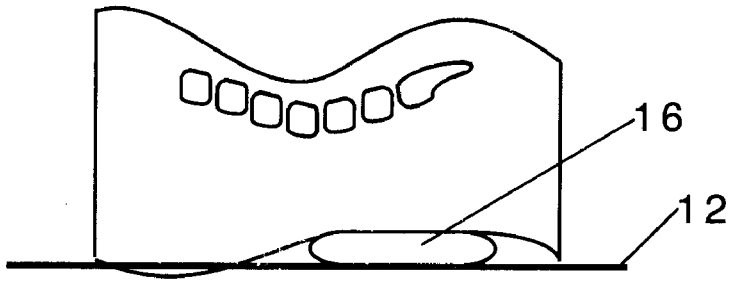
FIG. 4 is a depiction of the lumbar vertebrae of a prone individual using an abdominal pillow.

When sufficiently inflated and laid upon in a prone position, the mattress will encourage the spinal column of the resting body to assume the preferred curvatures. For instance, the depictions presented in FIGS. 3 and 4 illustrate the problematic lumbar curve (FIG. 3) of a body lying in the prone position. It is apparent that the preferred curve is almost nonexistent. By comparison, FIG. 4 illustrates the preferred lumbar curve achievable even by a body lying in the prone position with the assistance of an abdominal pillow 15.

Figure 5:
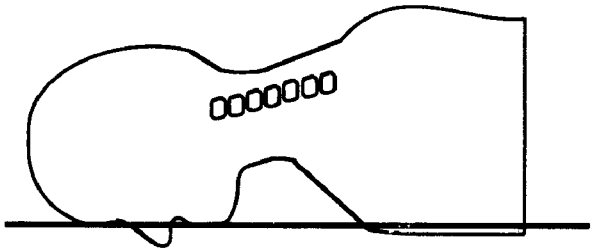
FIG. 5 is a depiction of the cervical vertebrae of a prone individual.
Figure 6:
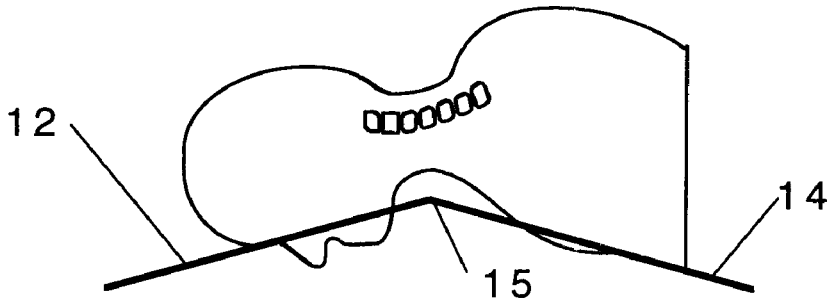
FIG. 6 is a depiction of the cervical vertebrae of a prone individual benefiting from the angularity of the disclosed mattress.

FIGS. 5 and 6 illustrate the effects of the advantageous design of the disclosed mattress on the curvature of the cervical vertebrae. FIG. 5 depicts the human body in an unassisted prone position with the natural curve of the cervical vertebrae essentially absent. FIG. 6 depicts the advantage of the sloping surfaces 14 and 16 in re-establishing the preferred cervical curve.

Ideally, the mattress will be constructed from any of a variety of inexpensive of plastic or rubberized materials known for their ability to be molded into the desired shapes of the pillows and bladders and to retain inflated air for reasonable lengths of time; each bladder and both pillows will have individual valves (not shown) for easy inflation.

Preferred dimensions of the mattress will be in the range of 28–32 inches wide and 76–80 inches long. The smaller sloping or "head" surface 14 will extend from the ridge 15 for about 12 inches to its terminus. It will preferably taper in thickness from about 12 inches at the juncture with the larger sloping surface 12 or ridge 15 to about 9 inches at the terminus, creating a slope Y of about 7°–10°.

The larger sloping surface 12 will extend from the ridge 15 for about 65–70 inches to its terminus. Preferred embodiments developed to date include molding a depression into the mid-area of the sloping surface 12 to accommodate the placement of the abdominal pillow, rather than simply placing the pillow directly on the surface. Preferably the larger sloping surface will taper in thickness from about 12 inches at the juncture with the ridge 15 to about 9 inches at the terminus to create slope X of about 3°–5°.

The abdominal pillow will preferably measure about 14 inches by 18 inches and be several inches thick. Currently, the abdominal pillow is designed to fit within a depression 21 on the larger sloping surface 12. It is also designed to be removed from its depression and attached to the pillow 18 on the smaller sloping surface 14 in the event that the user wishes to utilize the mattress in the supine position.

As mentioned supra, the pillow 18 on the smaller sloping surface 14 is preferably molded in the shape of a horseshoe to create a void 20 for the placement of the face. For attachment purposes, the pillow 18 can also be situated within a slight depression 23 in the surface of the smaller sloping surface 14.

While the foregoing is a complete and detailed description of the preferred embodiment of the disclosed inflatable mattress, it should be apparent that numerous variations and modifications of the mattress may be employed to implement the all-important purpose of the invention without departing from the spirit of the invention; and, therefore, the elaboration provided herein should not be construed to limit, in anyway, the scope of the invention, which is fairly defined by the appended claims.

What is claimed is:

1. An inflatable therapeutic mattress for supporting the human body in a prone position, said mattress comprising: an elongated support: portion having an upper surface comprising a pair of sloping surfaces, one larger than the other, each sloping in opposing directions from an elevated ridge on said upper surface;

an abdominal pillow positioned medially on the larger of said sloping surfaces to elevate the abdominal area of a resting body; and a head pillow positioned medially within the smaller of said sloping surfaces, having a void to accommodate the face of said resting body.

2. The mattress according to claim 1 wherein the head pillow is in the shape of a horseshoe.

3. The mattress according to claim 2 wherein the elongated body support portion consists of a plurality of inflatable bladders.

* * * * *